United States Patent [19]

Kerr et al.

[11] 4,292,629

[45] Sep. 29, 1981

[54] ALARM SYSTEM

[75] Inventors: Ronald R. Kerr; Keith M. Mullins, both of Ft. Collins, Colo.; Bruce H. Bowie, Sparks, Nev.

[73] Assignee: Teledyne Industries, Inc., Los Angeles, Calif.

[21] Appl. No.: 101,875

[22] Filed: Dec. 10, 1979

[51] Int. Cl.[3] ..... G08B 13/08

[52] U.S. Cl. ..... 340/547; 200/61.69; 200/61.72; 200/61.93; 335/205; 340/545

[58] Field of Search ..... 340/545, 546, 547; 200/61.69, 61.71, 61.72, 61.84, 61.93; 335/205, 207, 153

[56] References Cited

U.S. PATENT DOCUMENTS

| | | | |
|---|---|---|---|
| 2,912,540 | 11/1959 | Sawicki | 340/547 X |
| 3,636,485 | 1/1972 | Weathers | 335/205 |
| 3,706,090 | 12/1972 | Callaghan | 340/547 |
| 3,806,852 | 4/1974 | Suska | 335/205 |
| 3,943,485 | 3/1976 | Waldman | 340/547 X |
| 3,975,723 | 8/1976 | Bowling et al. | 340/547 |
| 4,160,972 | 7/1979 | LaMell et al. | 340/545 X |
| 4,170,005 | 10/1979 | Duke | 340/545 X |
| 4,210,888 | 7/1980 | Holce | 335/207 |
| 4,213,110 | 7/1980 | Holce | 335/207 |

*Primary Examiner*—John W. Caldwell, Sr.
*Assistant Examiner*—Joseph E. Nowicki
*Attorney, Agent, or Firm*—Hugh H. Drake

[57] ABSTRACT

An alarm system signals an attempt at intrusion through an opening framed to receive first and second panel members movable between opening and closing positions, as specifically shown in the form of a sliding glass door and screen door combination. An electrical switch mounted upon one panel has an element responsive to a magnetic field for developing a signal. A magnet mounted upon the other panel is productive of a magnetic field that interacts with the element of the switch upon movement of both the first and second panels to their closed positions. A signaling device coupled to the switch yields an alarm indication upon the beginning of the movement of either one of the panel members away from its closed position.

3 Claims, 4 Drawing Figures

ALARM SYSTEM

The present invention pertains to an alarm system. More particularly, it relates to an alarm system particularly adapted to movable doors and windows associated with a movable screen and for the purpose of signaling an attempt at intrusion by the beginning of opening of the screen.

Numerous burglar alarm systems are known. Among the oldest are those which include electrical switch contacts respectively on the jamb and on the closure of a door or window. In the closed condition, the contacts are engaged, so as to arm an associated circuit connected to an alarm-producing system. Opening of the closure breaks the contacts and effects the sounding of the alarm. Many other and usually more sophisticated systems have been developed. These include, for example, the use of invisible beams of optical energy sensed photo-electrically and coupled to cause the sounding of an alarm when interrupted. Silent and invisible standing wave patterns of ultrasonic energy have been caused to "flood" an enclosed space and be associated with sensing equipment that sounds an alarm upon any significant movement within the space.

One difficulty with most prior systems is that the actual act of intrusion usually must have either been accomplished or at least permitted as by the opening or breaking of a door or window. That is, the intruder has achieved access at least concurrently with the sounding of the alarm. In that case, the occupant or a security guard monitoring from a remote location is notified of the necessity to react only after a way of entry has been obtained. Even if a local alarm device then is activated, an occupant may have too little time to prepare to defend or a security service may have insufficient opportunity to respond before a knowledgable burglar or other with good planning may achieve his objective and escape. In addition, many such systems known to the prior art are comparatively expensive in either or both of cost of equipment and of installation.

Recognizing such deficiencies, one clever improvement is disclosed in co-pending application Ser. No. 866,789, filed Jan. 3, 1978, entitled Intrusion Alarm System and assigned to the same assignee as the present invention. In that approach, a normally self-contained alarm system is associated with a door knob or other type of latch. Upon the very slightest attempt to operate the latch, as many would-be intruders might do as a check to see if it were locked, an alarm is immediately sounded so as both to warn any occupant or observer and also to serve to scare away the undesired person. This unit is comparatively inexpensive and is capable of being installed rather simply by the user without the need even to drill holes, run wires or use special tools. Nevertheless, it does not lend itself readily to adaptation on doors and windows that do not have an external latch operator such as a door knob. This, of course, is the case at almost all windows and with many doors of the sliding type. Moreover, many sliding-type closures are not very secure even when locked.

It is, therefore, a general object of the present invention to provide a new and improved alarm system which overcomes various deficiencies present in previously-known systems.

Another object of the present invention is to provide a new and improved alarm system having particular advantage for use with sliding doors and windows, although also having utility with other manners of closure.

A further object of the present invention is to provide a new and improved alarm system arranged in a manner to afford a pre-intrusion alarm for use with closure members that do not have an external latch operator.

Still another object of the present invention is to provide such a new and improved alarm system which is economical and easy to install.

An intrusion alarm system in accordance with the present invention involves a first closure member cooperating with a second closure member movable relative thereto. An electrical switch is mounted upon one of the closure members and has an element responsive to a magnetic field for developing a signal; magnet means mounted upon the other closure member is productive of a magnetic field interactive with the element upon relative movement of the members into a predetermined relationship. Coupled to the switch is signaling means that yields an alarm indication upon the occurrence of a given interaction of the magnetic field with the switch element.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
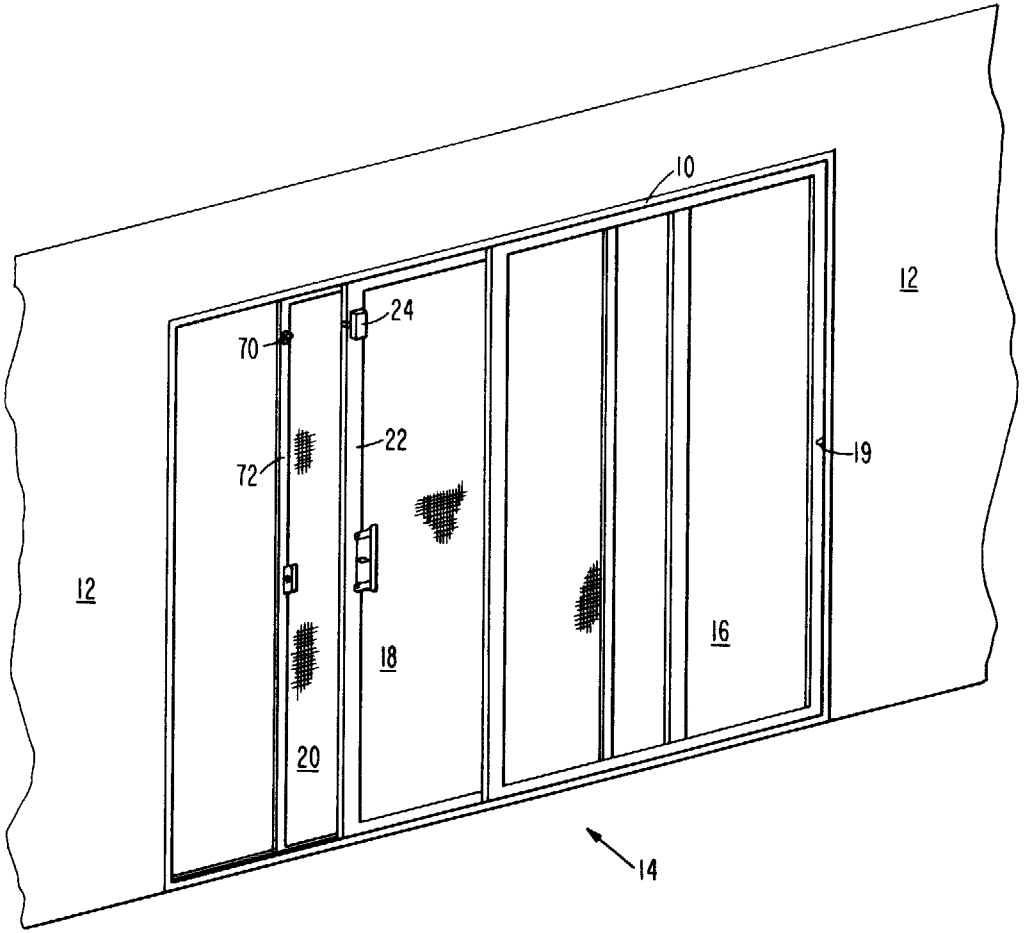
FIG. 1 is an isometric view of an overall sliding door arrangement to which the alarm system of the present invention has been applied.
Figure 2:
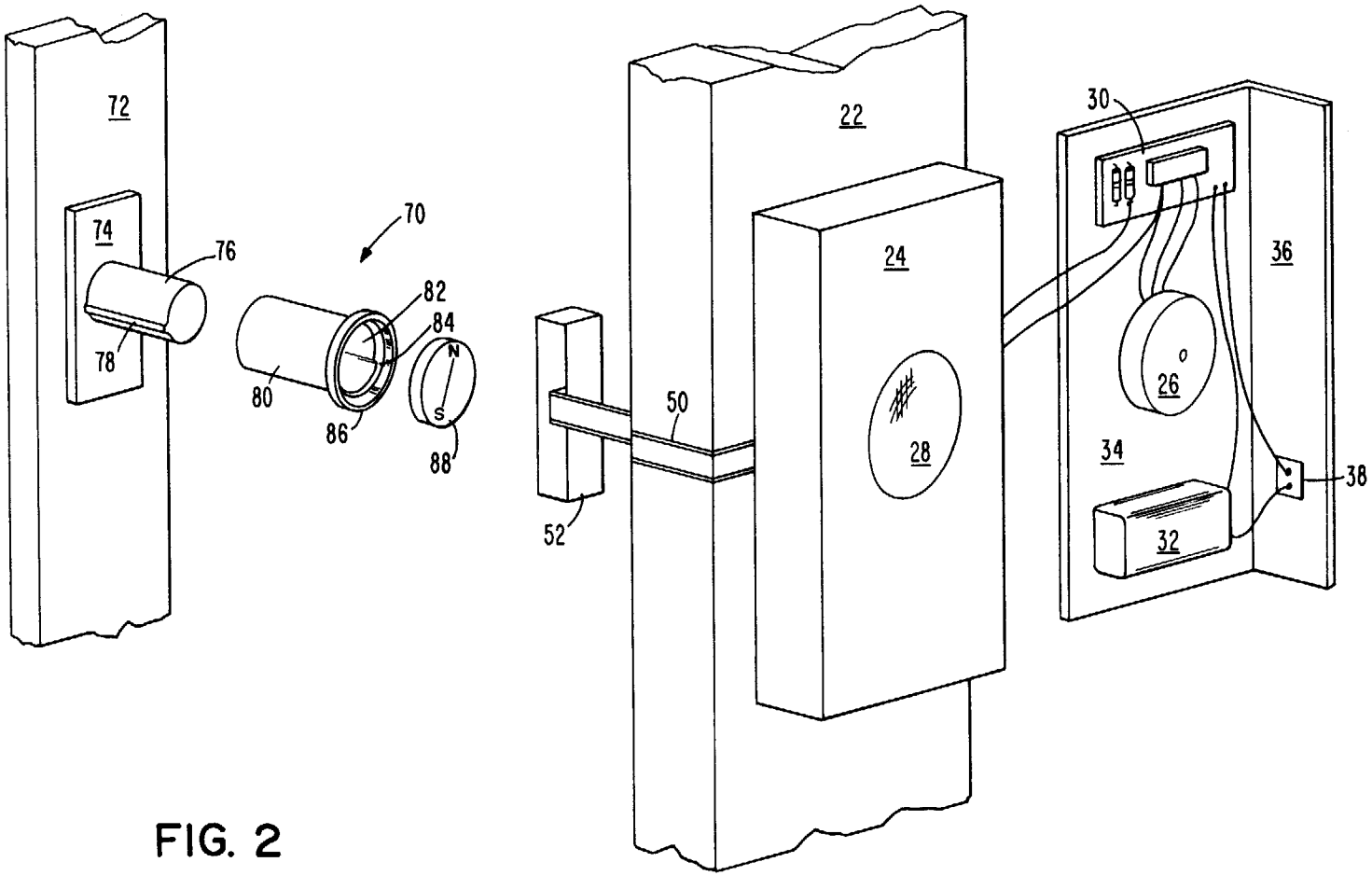
FIG. 2 is an enlarged, fragmentary, exploded isometric view of a portion of that which is shown in FIG. 1.
Figure 2A:
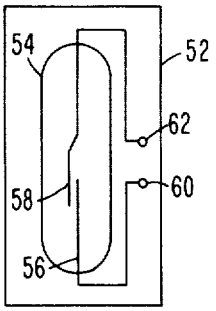
Figure 3:
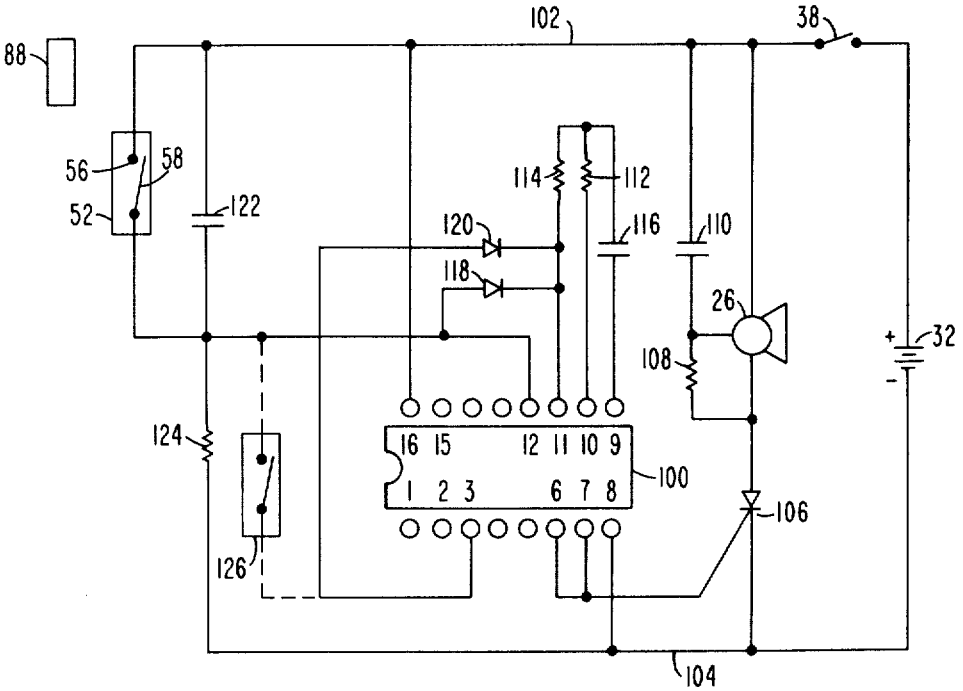

FIG. 2*a* is an enlarged fragmentary view broken away to show details within a component included in FIG. 2; and FIG. 3 is a diagram of a component in the alarm system installed on the arrangement of FIG. 1.

A door frame 10 is mounted in the wall 12 of a building in which is defined a place to be protected. Installed in frame 10 is a sliding door assembly 14 composed of a fixed glass door 16 that covers approximately one half of the opening defined by frame 10 and a sliding glass door 18 which also spans approximately one half of the opening defined by frame 10. Each of doors 16 and 18 is oriented generally parallel to the plane defined by frame 10, and sliding door 18 is mounted at its top and bottom in tracks defined by frame 10 so as to be slidable within the frame and relative to fixed door 16.

In its full open position, sliding door 18 is moved to a position so as almost to overlie fixed door 16. In at least most cases, a stop 19 is provided to prevent complete overlapping. This leaves a free margin for mounting a door pull and interior latch operator. As will be seen, that margin may also serve to mount a portion of the alarm system. On closure of the opening, sliding door 18 is, of course, moved in the other direction so as to be positioned laterally adjacent relative to fixed door 16. Typically, sliding door 18 is provided with an internal lockable latch that engages with the side of frame 10 so as to secure the opening in a closed condition. If an exteriorly-operated lock is in included, it is usually of the key-operated kind and is not part of a latch assembly operable either from the inside or the outside.

Also mounted within frame 10 and slidable within a track provided thereby is a screen door 20 oriented in parallel relationship to doors 16 and 18. Screen door 20 is movable into an open position at which it is aligned with fixed door 16 and also is aligned approximately with sliding door 18 when the latter is in its open position. On the other hand, screen door 20 may be moved to its other extreme at which it closes the opening and will be aligned with sliding door 18 when the latter is also in its closed position. Typically being of rather flimsy construction as compared to the glass doors, readily removable from its tracks for screen repair and the screen material itself being easily cut by a knife or a pair of scissors, it is at least rare that screen door 20 is provided with an external lock. It may, however, include a simple latch for the purpose of helping to insure that, when desired, it is held in a fully closed position so as to protectively cover the opening and prevent the entry of insects or animals.

Thus, doors 18 and 20 are each in the form of a panel or closure member movable relative to the other. Either one or both may serve at any given time to close the opening defined within frame 10 and, in this case, between the upright jamb of that frame and fixed door 16. On the other hand, either one or both of doors 18 and 20 may be disposed in a position that permits access through the opening.

Mounted upon the interior side of sliding door 18, as by means of a strip of pressure-sensitive adhesive material, directly to the glass or frame of the door and near or on its outer free margin 22, is a housing 24 that encloses self-contained signaling means for yielding an alarm indication. In this case, the alarm is in the form of an audible signal produced by an alarm horn 26 through a grill 28 in the wall of housing 24. Also confined within housing 24 is a printed circuit board 30 and an energizing power source in the form of a battery 32. Depending upon the form factor of housing 24 as finally designed and the width of door area available for mounting, the housing may be secured in place with either a narrow or a wide one of its exterior surfaces flat against a part of the door. If desired or necessary for a particular installation, an intervening bracket or the like may be used.

While horn 26, board 30 and battery 32 may be mounted within housing 40 by suitable clips or in any other manner to the interior walls of the housing, they are, in this case and solely for purposes of a representative illustration, mounted upon a tray 34 slidably insertable within housing 24 and having an outer and upstanding lip 36 that serves as a closing wall of housing 24. An on-off switch 38 is mounted upon and has its operator project through wall 36. As shown in FIG. 2, various wires interconnect to different components in a manner to be better understood with reference to the discussion of FIG. 3 below.

Leading outwardly from housing 24 and around the outer edge of door margin 22 is a flexible cable 50 which in this case needs to include only two electrical wires. Cable 50 preferably is adhesively backed for the purpose of affixing it in place. Cable 50 terminates in a housing 52 which in use is itself also affixed to sliding door 18 against the exterior face of margin 22. Housing 52 encloses an electrical switch which herein is of a conventional normally-open magnetically-operated reed type. Thus, the switch in itself includes a hermetically-shielded magnetically-transmissive capsule 54, typically of glass, within which is carried a fixed electrical contact 56 and a contact 58 movable upon interaction with a magnetic field, those two contacts being electrically connected to a pair of respective terminals 60 and 62 to which a pair of wires within flexible cable 50 are correspondingly connected. Such reed-type magnetically-actuable switches are well known. Alternatively, a semi-conductive solid-state switch may be substituted, so long as it satisfies the criteria of switch operation as between an open and a closed condition in a circuit in response to change as between the presence or absence of a separately-induced magnetic field.

For producing such a magnetic field, a magnet assembly 70 is mounted from the outer margin 72 of sliding screen door 20 and in a comparative vertical position, so as to come into alignment with switch housing 52 whenever both sliding doors 18 and 20 are so positioned that margin 72 overlies margin 22 as is the case when both of those doors are in the position to close the opening defined by frame 10. As particularly embodied, magnet assembly 70 includes a base 74 secured, as again by a piece of a pressure-sensitive adhesive layer, to the inner side of margin 72 facing door 18. Outstanding from base 74 and projecting toward door 18 is a generally-cylindrical stub 76 formed to define a longitudinal radially-projecting rib 78.

Receivable over stub 76 in one orientation is a sleeve 80, the bore 82 of which gradually decreases in diameter in a circumferential direction from a given location until reaching an abrupt longitudinal step 84 back to the original location. The radius of rib 78 is such as to permit receipt of the stub within sleeve 80 in appropriate relative rotational relationship between the two but to lock sleeve 80 upon stub 76 upon rotation of step 84 away from rib 78.

Projecting on toward door 18 integrally from sleeve 80 is a collar 86 in which is seated, as by cementing or sonic welding, a magnet 88 in the form of a disc. Preferably, all of base 74, stub 76, sleeve 80 and disc 88 are molded or otherwise formed of a plastic material. The outer major surface of disc 88 is, however, coated with a magnetizable material which is magnetized to define north and south poles at opposite ends of a diameter as indicated. Alternatively, the entire disc is molded of a magnetizable material and so magnetized. In any case, the poles may be oriented relative to step 84 and rib 78 to interact most affirmatively with movable contact 58.

As shown in FIG. 3, the nature of the electronic circuitry is basically the same as that employed in the system of the aforementioned co-pending application. Controlling operation is an integrated-circuit device 100 in this case in the form of an RCA 4060. Its standardized pin numbers are indicated within the outline of its representation. As herein adapted, normally-open contacts 56 and 58 within switch housing 52 are bridged between pin 12 of device 100 and a positive bus 102, the latter being connected through on-off switch 38 to the positive terminal of battery 32. Contact 58 closes against contact 56 when magnet 88 moves into a nearby position.

A negative bus 104, extending from the negative terminal of battery 32, is connected through the power terminals of a silicon-controlled rectifier 106 to one side of horn 26 the other side of which is returned to positive bus 102. In an entirely conventional manner, as such, horn 26 internally includes, in series with its electromechanical driving winding, a pair of inversely-connected diodes that function together with an external resistor 108 connected in shunt to that winding and returned to bus 102 through a capacitor 110 from the end of resistor 108 remote from controlled rectifier 106. The resulting network serves to interrupt the supply of power through the horn and controlled rectifier 106 from battery 32 on a periodic basis, so as to terminate operation of horn 26 upon removal of the control signal supplied to the gate of controlled rectifier 106 from output terminals 6 and 7 of device 100.

The series combination of a pair of resistors 112 and 114 bridges device pins 10 and 11, and a capacitor 116 is connected between the junction between those resistors and pin 9. The value of capacitor 116 is one control upon the duration of continued operation of horn 26 following any actuation of the system by the opening of the switch defined by elements 56 and 58.

Pin 11 is returned to pin 12 by a diode 118 and to pin 3 by a diode 120. Also affecting duration, by reason of the internal circuitry of device 100, is the particular pin to which the anode of diode 120 is connected. For the illustrated arrangement in which that connection is to pin 3 and with a given value of capacitor 116, for example, closure of switch contacts 56 and 58 will result in the sounding of an alarm for a period of about one minute. A change of the return from pin 3 to pin 2 would reduce that time interval to one-half minute, connection to pin 1 resulting in a duration of fifteen seconds and connection to pin 15 resulting in a duration of only four seconds. For any given one of those connections, doubling the value of capacitor 116 results in approximately a doubling of the time interval.

As particularly shown, a transient-suppressing capacitor 122 is connected to bridge switch contact elements 56 and 58 and a biasing resistor 124 is returned from pin 12 to ground bus 104. Also shown in FIG. 3 by dashed-line connections is an optional normally-open test switch 126. As will be discussed further, switch 126 need not be included for most uses, because the opening of either of doors 18 or 20 will activate the alarm and, thus, serve for ordinary test purposes. Should the situation be such, however, that is desired to achieve such a test without having to open either door, switch 126 may be included, as for example by means of a pushbutton projecting through any exposed wall of housing 24, for user operation.

After installation of the components upon the doors, sensitivity is adjusted by manipulating sleeve 80 upon stub 76 so as to vary the distance of magnet 88 from switch housing 52. For each different position tired, one or the other of of doors 18 and 20 is opened an amount to cause actuation of the alarm, and adjustment of the distance of the magnet from the housing is varied until, desirably, only an opening of screen door 20 by an amount of, perhaps, one or two inches is sufficient to actuate the alarm. When the proper distance has been determined, sleeve 80 is simply twisted so as to lock the sleeve upon stub 76 by cam action between the outer end of rib 78 and the surface of bore 82.

Without more, the system described has a high degree of inherent protection. The use of magnetic coupling to cause switch operation accommodates the often somewhat flimsy nature of the screen door, as a result of which distortions in shape from use or occasioned by wind are accommodated by the adjustment of sensitivity afforded by manipulation of sleeve 80 upon stub 76.

Moreover, the strength of magnetization of disc 88 may be sufficient that movable reed switch contact element 58 will be actuated regardless of the orientation of the magnetic poles established on the disc. Thus, disc 88 may be mounted within collar 86 without any identification of the location of the poles, and it preferably is so placed in a random manner. As a result, there is additional protection against an attempt by a knowledgable intruder to "fool" the sensing mechanism by using his own magnet, perhaps inserted through a cut made in the screen, to override the function of magnet 88. Unless the intruder's applied magnet just happened to be presented with close to the same orientation as the pole diameter established on disc 88, his "fooler" magnet would at least in part oppose the field already established by magnet 88, enable movable reed switch element 58 to open the circuit and, thus, cause the alarm to be sounded.

Still an additional degree of protection may be added if desired. A separate reed switch, connected into the circuitry the same as optional test switch 126 illustrated and discussed with regard to FIG. 3 and in addition thereto or in place thereof, may be mounted in a position near housing 52 but just sufficiently far from magnet 88 when the doors are in the closed position as not to be actuated by that magnet. Any attempt by the intruder to insert a "fooler" magnet into the vicinity would effect closure of such an additional switch, and thus sound the alarm, even if it, by chance, happened to be so oriented as to present a magnetic field that overrode opening of switch element 58.

As particularly embodied, the alarm system has been used with sliding doors. Clearly, it is equally adaptable to other closures such as sliding windows. Moreover, it has been presented in its desirable aspect of a "kit", having a form such that a user may easily install it, even without the need for tools, upon an existing sliding-enclosure system. On the other hand, it is apparent that the very same alarm system may be supplied in original equipment manufacture as an integral part of a complete closure arrangement, in which case all wiring may be disposed internally of the closure members concerned and the physical components may even in large part be incorporated within the assembly of the door or window framing members.

The same apparatus also is adaptable to a pair of closure members one of which, for example, swings away from the other. That is, magnet 88 would be mounted upon one such member and housing 52 would be mounted upon the other. Any attempt to swing one of the members away from the other would result in actuation of the alarm. However, some other forms of implementation may lose a degree of the aforementioned preintrusion feature. That is, a final door may have to be opened, thus permitting at least partial access, in order to operate the alarm. On the other hand, the system may retain the pre-intrusion feature as applied to sense movement of the aforementioned swingable screen or storm-protective closure relative to an inner window or door, as when a would-be intruder first attempts to remove the screen to get at the inner door or window.

While the switch within housing 52 may be normally closed and connected in the manner of test switch 126, so as to be in the open mode when activated by magnet 88, this approach is not preferred for the specific embodiment shown. It normally would not be as fail-safe against the different possibilities for an approach to enter.

One other feature deserves to be mentioned. In a given situation, a user may desire to leave both of a pair of sliding doors slightly open to allow access by such as a cat or dog. Analogously, a storm window might desirably be only partly opened. Thus, the "opening" to be protected may not be entirely closed but, instead may be only closed to a degree prohibiting human access. The system disclosed will work the same, because it contemplates the relative alignment of edge margins or other parts of doors or windows on which the interactive components are mounted. Accordingly, the terms "closed" and "opening" or their derivatives or parents as used herein are intended to embrace other than a necessarily complete blockage.

It will thus been seen that a highly effective, very versatile and yet inexpensive arrangement has been provided in satisfaction of the previously-mentioned objectives. It is both economical and comparatively fool-proof. The mere beginning of the opening of either closure member actuates the alarm. Yet, the system is reset and re-armed upon only the return of both members to a closed position.

While a particular embodiment of the invention has been shown and described, and several alternatives have been presented, it will be obvious to those skilled in the art that changes and modifications may be made without departing from the invention in its broader aspects. Therefore, the aim in the appended claims is to cover all such changes and modifications as fall within the true spirit and scope of that which is patentable.

We claim:

1. An intrusion alarm system comprising:

a first closure member;

a second closure member movable relative to said first closure member;

an electrical switch mounted upon one of siad closure members and having an element responsive to a magnetic field for developing a signal;

magnet means mounted upon the other of said closure members and productive of a magnetic field interactive with said element upon raltive movement of said members into a predetermined relationship;

signaling means coupled to said switch for yielding an alarm indication upon the occurrence of a given interaction of said field with said element;

means for mounting said magnet means on said other member in a position adjustably selectable in distance from said element, said mounting means including:

an outstanding stub from which a rib radially projects;

a sleeve the base of which gradually decreases in diameter in a circumferential direction from a given location until reaching an abrupt step back to said location;

and the radius of said rib permitting receipt of said stub within said sleeve in an appropriate relative rotational relationship but locking said sleeve to said stub upon rotation of said step relatively away from said rib.

2. A system as defined in claim 1 in which said sleeve includes a collar projecting outwardly and in which said magnet means includes a disc secured with said collar.

3. A system as defined in claim 2 in which said disc includes a material magnetized in the direction of a diameter of the disc.

* * * * *